US009836951B1

(12) United States Patent
Perry

(10) Patent No.: US 9,836,951 B1
(45) Date of Patent: Dec. 5, 2017

(54) EMERGENCY ALERT DEVICE

(71) Applicant: Emra B Perry, Jacksonville, FL (US)

(72) Inventor: Emra B Perry, Jacksonville, FL (US)

( * ) Notice: Subject to any disclaimer, the term of this patent is extended or adjusted under 35 U.S.C. 154(b) by 0 days.

(21) Appl. No.: 14/995,255

(22) Filed: Jan. 14, 2016

(51) Int. Cl.
*G08B 1/08* (2006.01)
*G08B 25/01* (2006.01)
*G08B 25/10* (2006.01)
*G08B 25/12* (2006.01)

(52) U.S. Cl.
CPC ..... *G08B 25/016* (2013.01); *G08B 25/10* (2013.01); *G08B 25/12* (2013.01)

(58) Field of Classification Search
None
See application file for complete search history.

(56) References Cited

U.S. PATENT DOCUMENTS 3,825,833 A * 7/1974 Bogue ..... G08B 25/016 340/539.1
4,223,541 A * 9/1980 Martinez ..... A44C 9/02 384/626
4,535,324 A * 8/1985 Levental ..... G08B 21/0297 340/531
5,835,907 A * 11/1998 Newman ..... G08B 25/016 340/539.13
5,964,701 A * 10/1999 Asada ..... A61B 5/02438 128/903
6,050,695 A * 4/2000 Fromm ..... A44C 15/0015 362/104
8,081,951 B1 * 12/2011 Blum ..... G08B 25/12 340/539.12
8,227,956 B2 * 7/2012 Graumann ..... H02N 2/183 310/339
8,249,547 B1 8/2012 Fellner
9,030,317 B1 * 5/2015 Alexander ..... G08B 25/016 340/539.1
2003/0177787 A1 * 9/2003 Kuo ..... A44C 9/02 63/15.45
2009/0322513 A1 12/2009 Hwang et al.
2010/0168531 A1 * 7/2010 Shaltis ..... A61B 5/02241 600/301
2012/0212339 A1 * 8/2012 Goldblatt ..... G08B 25/016 340/539.11
2012/0242481 A1 * 9/2012 Gernandt ..... G06K 19/0705 340/539.13
2013/0158627 A1 * 6/2013 Gozani ..... A61N 1/0456 607/46
2013/0331058 A1 12/2013 Harvey
(Continued)

FOREIGN PATENT DOCUMENTS

AU 2013200457 A1 * 8/2014 ..... G08B 25/08
CN 204132684 U * 8/2014 ..... H04M 1/02
CN 204180114 U * 2/2015 ..... A45F 5/00

*Primary Examiner* — Quan-Zhen Wang
*Assistant Examiner* — Chico A Foxx
(74) *Attorney, Agent, or Firm* — Lawrence J. Gibney; Mitchell Ghaneie

(57) ABSTRACT

This device will be placed around the finger of an individual so that person can send a remote alarm in an unforeseen event. This will be particularly useful when individuals are in remote locations with strangers or people that are not necessarily known by the user of this device. The user may also be allowed to preset controls of the device to send automatic alarms.

19 Claims, 4 Drawing Sheets

(56) References Cited

U.S. PATENT DOCUMENTS

| | | | | |
|---|---|---|---|---|
| 2014/0240088 | A1* | 8/2014 | Robinette | G08B 13/1427 340/5.61 |
| 2014/0247124 | A1 | 9/2014 | Ros | |
| 2015/0109123 | A1* | 4/2015 | Ros | G08B 15/004 340/539.11 |
| 2015/0332563 | A1* | 11/2015 | Davis | G08B 5/006 342/66 |
| 2016/0104355 | A1* | 4/2016 | Alexander | G08B 25/009 340/692 |
| 2016/0134737 | A1* | 5/2016 | Pulletikurty | G06F 3/0227 715/735 |

* cited by examiner

EMERGENCY ALERT DEVICE

BACKGROUND OF THE INVENTION

A. Field of the Invention

This relates to the safety of individuals when sometimes in remote locations. This device can be used by anyone who is required to travel to remote locations particularly with unknown individuals. For instance, the device can be used by real estate professionals who are required to show properties often times in remote locations to strangers. In order to protect the professional from an unknown danger this device will allow a professional to alert a specified or predetermined contact and also allow the professional to send an alarm in the event of a danger.

B. Prior Art

Much of the wearable emergency alert devices in the prior art are meant to be concealed or disguised as another object. In addition, few devices within the prior art can be operated with the same hand on which it is worn. For example, with a watch the user must use the opposite hand to operate the watch. Furthermore, with a necklace the user will be required to bring his or her hand up to the neck region to operate the device. This is substantially important for operation of the device in the event that the user's hands are restricted from movement.

A representative example of this type of device is illustrated by Fellner U.S. Pat. No. 8,249,547 which is a device that incorporates an emergency alert device with a mobile phone. Another example can be found at Hwang U.S. Patent Application Publication Number 2009/0322513. None of the other prior art references incorporate all the features of the current application.

BRIEF SUMMARY OF THE INVENTION

This is a wearable device which is placed around the fingers of an individual. It will be compromised of a rigid hard plastic casing which will have a visual screen at one end and appropriate finger holes for the user. The finger holes or shank will be somewhat flexible to allow the device to be used by a variety of people with different finger sizes. The device can be worn on either hand.

This display will indicate the time of departure as well as also provide a stopwatch or alarm system in the event that an appropriate response from the user has not been received by the monitoring party or an unforeseen circumstance has arisen. On the bottom surface will be an alert button where the user can notify the appropriate parties in the event that something unfortunate has happened.

A speaker and microphone will also be included so that the user can notify a predetermined party about the possible danger that has occurred.

A power source, which is likely a battery, has been provided and in order to avoid the necessity of needing to frequently replace the power source, a recharging port will also be provided. The recharging port will accommodate a variety of charging connectors.

Because this device may be taken to remote locations, a transmitter will be provided so that the location of the individual can be determined using a global positioning system (GPS).

Once the alarm button has been pressed the device will then emit an alert signal to a predetermined set of contacts, a monitoring station, or both. After which, the contacted individual(s) may then contact emergency authorities or personally check on the distressed user.

NUMBERING DESCRIPTION

Figure 1:
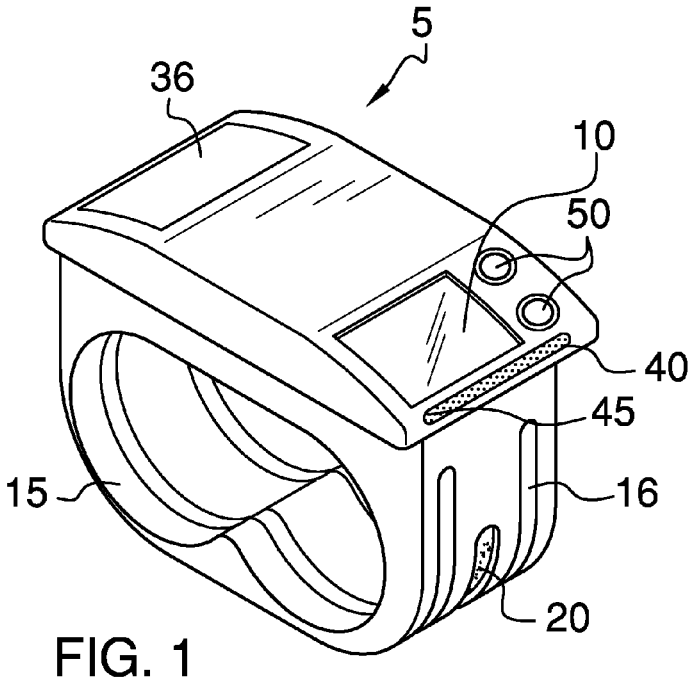
FIG. 1 is an isometric view of the device from the top depicting a screen, two function control buttons, a microphone and speaker, a ring for fingers, two cutaways in the two finger ring for flexibility, and an alarm button.
Figure 2:
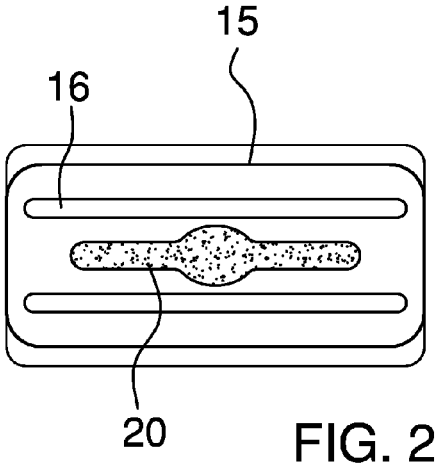
FIG. 2 is a bottom view of the device depicting the ring for fingers, the alarm button, and the two cutaways in the ring for fingers.
Figure 3:
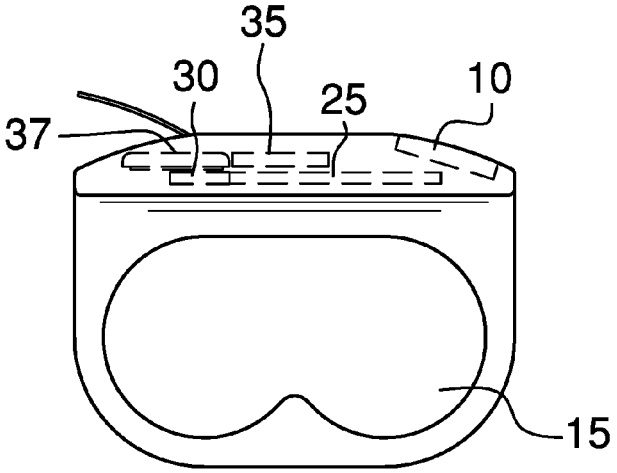
FIG. 3 is a front view of the device depicting the ring for fingers, the screen, and several interior parts of the device which include, a cover to a charging port compartment, a charging port, a power source, a microprocessor, and a transmitter.
Figure 4:
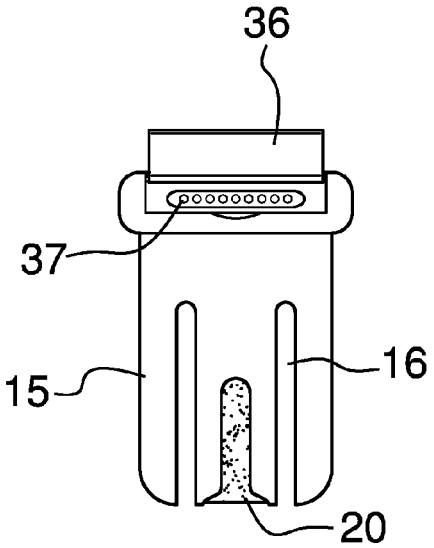
FIG. 4 is a side view depicting the ring for fingers, the two cutaways in the ring, the alarm button, a charging port compartment, and the charging port.
Figure 5:
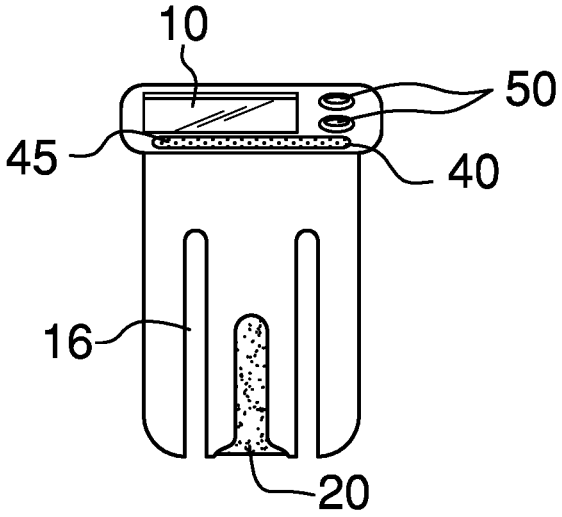
FIG. 5 is a side view depicting the two finger ring, the screen, two function control buttons, the speaker, the microphone, the cutaways, and the alarm button.

5 Device
10 Screen
15 Ring for fingers
16 Cutaways
20 Alert button
25 Microprocessor
30 Transmitter
35 Power source
36 Charging port compartment
37 Charging port
40 Speaker
45 Microphone
50 Function Control Button

DETAILED DESCRIPTION OF THE EMBODIMENTS

When prospective home buyers or tenants are shown property or other assets in remote locations by another individual it is prudent that the individual take the necessary precautions for safety. This device will protect the safety and well-being of the individual who is showing the property by providing a hand-held portable device that is placed on the person's finger or fingers by placing the person's fingers through the ring for the fingers 15 or shank. There are a plurality of flexible cutouts or cutaways 16 that are adjacent to the ring for fingers 15. Although this device is discussed in relationship with real estate professionals, it can be used in a variety of applications.

This device 5 may have multiple applications but in terms of this application the device will be used in the context of a real estate professional who is required to show property to prospective unknown buyers or unknown sellers. At times the professional will know very little about the individual and safety is a priority. The device may also be used in applications where an individual is simply being shown assets (not necessarily real estate) to unknown individuals.

Figure 6:
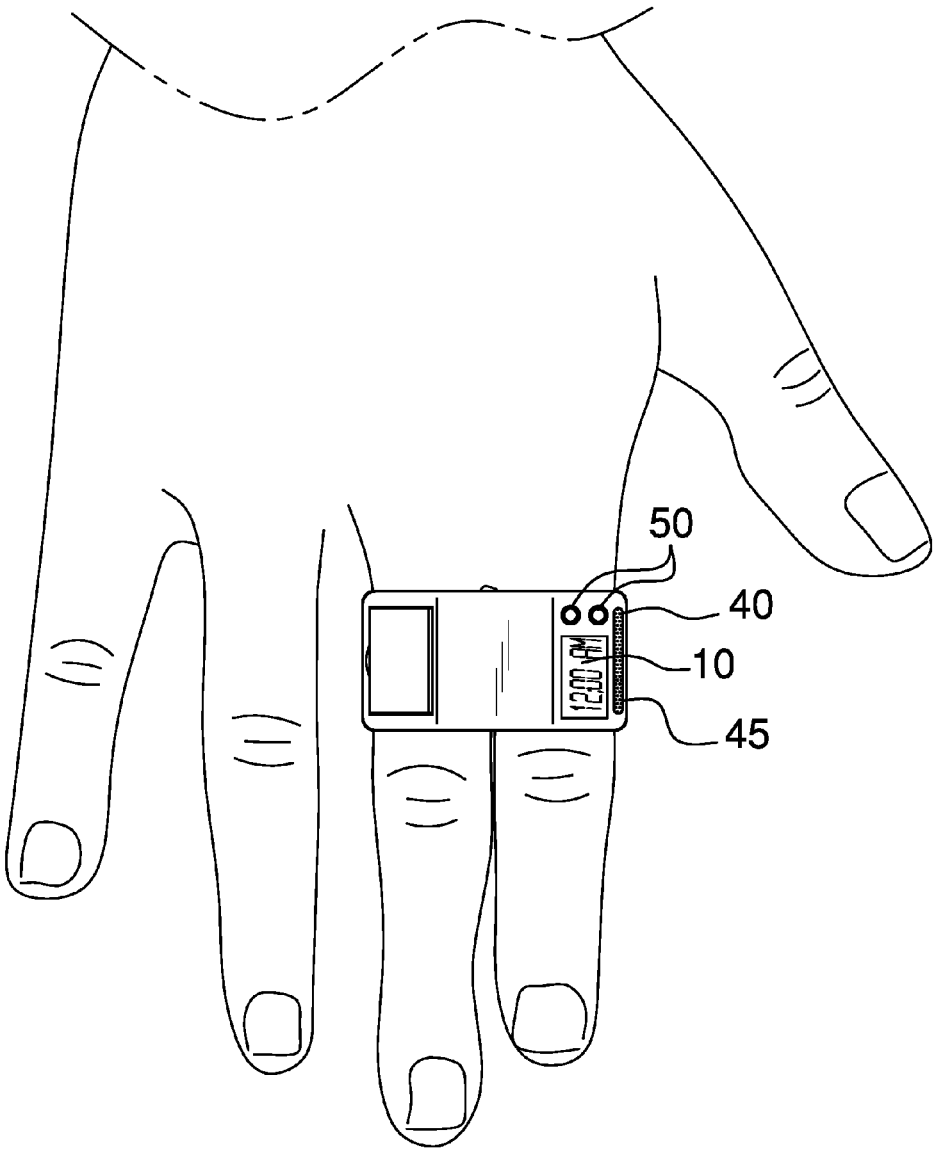
FIG. 6 is an in use view depicting the device being worn on two fingers and displaying a time on the screen.

The device 5 will be worn on the user's fingers such as shown in FIG. 6. It will likely be made from a rigid plastic casing. On one end of the casing a display 10, speaker 40, and microphone 45 are provided.

On the opposite end of the display will be a charging port 37. A power source 35, a transmitter 30, and a microprocessor 25 are contained in the rigid hard casing. An appropriate charging port compartment 36 opening is also provided to charge the battery. The power source in the present invention is a rechargeable battery. The charging port 37 will be provided to maximize the battery life. Alternatively, it is contemplated and anticipated that the power source may be replaceable.

On the bottom surface of the casing an alert button 20 will be provided to notify a selected number of other individuals in the case of an emergency.

In addition, in order to accommodate the power needs of this device it is anticipated that the display will be a LED screen and will be constructed so that it will minimize power use.

A plurality of function control buttons 50 are provided on the device next to the screen 10. The user may use these buttons to perform a variety of functions such as toggle through various displays on the screen, call in to a monitoring center or user's office, or as a code for user identification.

The provided microphone 45 and speaker 40 allow the user to communicate with another party at a separate location. For example, a monitoring center may call the device after the alarm button 20 is pressed and speak with its user. The user may then provide a secret passphrase or word to inform the monitoring center that the alarm button was pressed accidently. The user may use an alternative word or passphrase if being forced to communicate through the device while under duress.

While the presented embodiment of the device shows the microphone 45 and the speaker 40 within relatively close proximity to each other on the same face of the casing, it is anticipated that the two may be located on different faces of the device.

The device also provides a GPS locator. The GPS locator allows for the user's location to be monitored during use. The GPS locator is housed within the casing of the device. The GPS locator operates in connection with the microprocessor and controller.

While the embodiments of the invention have been disclosed, certain modifications may be made by those skilled in the art to modify the invention without departing from the spirit of the invention.

The inventor claims:

1. An emergency alert device, which is comprised of:
- a shank that accommodates two fingers of a hand of a user, wherein the shank is further comprised of:
  - an upper shank portion and a lower shank portion, wherein the lower shank portion has a bottom surface;
- a plurality of cutaways, wherein the plurality of cutaways is provided within the shank;
- a plurality of components, wherein the plurality of components is further comprised:
  - a controller;
  - a screen to displays information to the user;
  - a power source to provide power to the emergency alert device, wherein the power source is rechargeable;
  - a charging port to allow the power source to be charged;
  - an alarm button provided within the bottom surface;
  - a transmitter, wherein the transmitter sends information wirelessly to a separate device;
  - a global positioning device;
  - a microphone; and
  - speaker;
- wherein the controller is in electrical communication with the plurality of components to control operations thereof, the controller further configured to be programmed by the user, to permit configuration of the emergency alert device;
- wherein the alarm button is provided between the plurality of cutaways; and
- wherein the alarm button is provided within the bottom surface to enable pressing by at least one of the accommodated two fingers to indicate that the user is in a distressed situation.

2. The emergency alert device as described in claim 1 wherein the emergency alert device is configured to signal an alert without the alarm button being activated.

3. The emergency alert device as described in claim 1 wherein an alert signal is transmitted to at least one selected contact.

4. The emergency alert device as described in claim 1 wherein the alarm button provides a texture.

5. The emergency alert device as described in claim 1 wherein the alarm button can be pressed by a thumb of a hand to which the emergency alert device is worn on.

6. The emergency alert device as described in claim 1 wherein the alarm button is recessed into the shank.

7. The emergency alert device as described in claim 1 wherein the screen displays an alarm signal.

8. The emergency alert device as described in claim 1 wherein the controller is programmed with a function control button.

9. The emergency alert device as described in claim 1 wherein the shank is flexible.

10. The emergency alert device as described in claim 1 wherein the charging port is within a charging port compartment.

11. The emergency alert device as described in claim 1 wherein the alarm button has a first end, a second end, and a middle section between the first end and the second end.

12. The emergency alert device as described in claim 11 wherein the middle section of the alarm button is wider than the first end and is wider than the second end of the alarm button.

13. The emergency alert device as described in claim 1 wherein the global position device provides the location of the emergency alert device.

14. The emergency alert device as described in claim 1 wherein the microphone and the speaker provide for two-way communications.

15. An emergency alert device, which is comprised of:
- a shank that accommodates two fingers of a hand of a user, wherein the shank is further comprised of:
  - an upper shank portion and a lower shank portion, wherein the lower shank portion has a bottom surface;
- a plurality of cutaways, wherein the plurality of cutaways is provided within the shank;
- a plurality of components, wherein the plurality of components include:
  - a controller;
  - a screen to displays information to the user;
  - a power source to provide power to the emergency alert device, wherein the power source is rechargeable;

a charging port to allow the power source to be charged;

wherein the charging port allows for the power source to be recharged;

an alarm button provided within the bottom surface, wherein the alarm button provides a texturized surface, and alarm button can be pressed be pressed by a thumb of a hand to which the emergency alert device is worn on;

a transmitter, wherein the transmitter sends information wirelessly to a separate device;

a global positioning device, wherein the global positioning device provides the location of the emergency alert device;

a microphone; and speaker, wherein the microphone and speaker provide for two-way communications;

wherein the controller is in electrical communication with the plurality of components to control operations thereof, the controller further configured to be programmed by the user, to permit configuration of the emergency alert device;

wherein the alarm button is provided between the plurality of cutaways; and wherein the alarm button is provided within the bottom surface to enable pressing by at least one of the accommodated two fingers to indicate that the user is in a distressed situation.

16. The emergency alert device as described in claim 15 wherein the emergency alert device is configured to signal an alert without the alarm button being activated.

17. The emergency alert device as described in claim 15 wherein an alert signal is transmitted to at least one selected contact.

18. The emergency alert device as described in claim 15 wherein the alarm button is recessed in the lower shank portion.

19. The emergency alert device as described in claim 15 wherein the controller is programmed with a plurality of function control buttons.

* * * * *